United States Patent [19]

Fitch

[11] 3,983,941

[45] Oct. 5, 1976

[54] WELL COMPLETION TECHNIQUE FOR SAND CONTROL

[75] Inventor: John L. Fitch, Dallas, Tex.

[73] Assignee: Mobil Oil Corporation, New York, N.Y.

[22] Filed: Nov. 10, 1975

[21] Appl. No.: 630,104

[52] U.S. Cl. ..... 166/276; 166/287; 166/288

[51] Int. Cl.[2] ..... E21B 43/02

[58] Field of Search ..... 166/276, 278, 280, 285, 166/287, 292, 297, 288

[56] References Cited

UNITED STATES PATENTS

| | | | |
|---|---|---|---|
| 3,044,547 | 7/1962 | Jarboe | 166/276 |
| 3,097,694 | 7/1963 | Kerver | 166/276 |
| 3,233,673 | 2/1966 | Spain et al. | 166/280 |
| 3,237,693 | 3/1966 | Huitt et al. | 166/280 |
| 3,333,635 | 8/1967 | Crawford | 166/276 |
| 3,336,980 | 8/1967 | Rike | 166/297 |
| 3,672,449 | 6/1972 | Richardson et al. | 166/292 |
| 3,709,298 | 1/1973 | Pramann | 166/276 |
| 3,800,847 | 4/1974 | Rike | 166/276 |
| 3,814,187 | 6/1974 | Holman | 166/292 |
| 3,826,310 | 7/1974 | Karnes | 166/276 |

*Primary Examiner*—Ernest R. Purser
*Assistant Examiner*—Jack E. Ebel
*Attorney, Agent, or Firm*—C. A. Huggett; Henry L. Ehrlich

[57] ABSTRACT

This specification discloses a method of completing a cased well that penetrates a subterranean formation to control the production of sand from the formation. The well is provided with perforation tunnels that extend through the casing and communicate with the formation. Removable plugs are formed in the perforation tunnels and thereafter a gravel pack is formed and consolidated in the well within the casing adjacent the perforation tunnels. Thereafter the removable plugs are removed from the perforation tunnels to provide unobstructed tunnels for the flow of fluids from the formation into the well. The formation adjacent the perforation tunnels may also be consolidated to mitigate the movement of sand from the formation into the perforation tunnels.

8 Claims, 3 Drawing Figures

WELL COMPLETION TECHNIQUE FOR SAND CONTROL

BACKGROUND OF THE INVENTION

This invention relates to a method of completing a well that penetrates a subterranean formation and more particularly relates to a well completion technique wherein an inside-the-casing consolidated gravel pack is formed within the well to control the production of sand from the formation.

In completing a well that is drilled into the earth and penetrates a subterranean fluid-bearing formation, a string of casing is often run into the well and a cement slurry flowed into the annulus between the casing string and the wall of the well and allowed to set and form a cement sheath to bond the casing to the wall of the well. A perforating means may be lowered into the well adjacent the fluid-bearing formation of interest and activated to perforate the casing and cement sheath and provide perforation tunnels which communicate between the interior of the well and the subterranean formation.

The subterranean formation may be an unconsolidated or loosely consolidated formation or may essentially be a consolidated formation having streaks or zones of friable material. When fluids such as oil or gas are produced from such formations, the produced fluids may carry entrained therein formation material, hereinafter referred to as "sand". The production of sand from a formation into a well is undesirable for many reasons. It is abrasive to components found within the well such as tubing, pumps and valves and must be removed from the produced fluids at the surface.

Various techniques have been used to control the production of sand from subterranean formations. Two commonly used techniques are gravel packing and formation consolidation techniques. Gravel packing involves generally the placement of gravel within a well adjacent a formation from which fluids are to be produced to form a gravel filter. In a cased perforated well the gravel may be placed inside the casing adjacent the perforations to form an inside-the-casing gravel pack or may be placed outside the casing and adjacent the formation or may be placed both inside and outside the casing. The gravel may be consolidated by use of consolidating materials to better hold it in place. Techniques for forming gravel packs and inside-the-casing consolidated gravel packs are well known. For example, in U.S. Pat. No. 3,621,915 there is described a method of providing sand control of underground formations penetrated by a well by forming an epoxy resin consolidated sand or gravel pack of high compressive strength in the well. A description of inside gravel packing methods is given in an article entitled "Sand Control", Part 5 — Inside Gravel Packing, by George O. Suman, Jr., World Oil, pp. 67–76, March 1975. Suman there points out that careful gravel packing of perforations as well as the screen-casing annulus assures maximum benefit from gravel placement jobs inside casing.

Formation consolidation techniques of sand control involves generally the injection of sand consolidation chemicals into unconsolidated formations to consolidate the formations in situ. The sand consolidation chemicals often used include Phenol resin, Phenol-formaldehyde, Epoxy, Furan and Phenolicfurfuryl. In Part 7 of the aforementioned "Sand Control" article entitled "Consolidating Formation by Chemical Methods Requires Precise Application and, Careful Fluid Handling", published in World Oil, pages 75–83, May 1975, there is tabulated available systems for consolidating formations in place or for packing perforations with resincoated gravel slurries.

In a two-part article by J. L. Rike entitled "Shortcomings of Present Sand-Control Methods Suggest New Fail-Safe Concept — 1", The Oil and Gas Journal, pages 97–102, Feb. 17, 1975, and "Shortcomings Suggest New Fail-Safe Concept", The Oil and Gas Journal, pages 76–80, Feb. 24, 1975, there is described a new fail-safe concept that has been developed for sand control in high-rate wells and for stimulation of unconsolidated sands. The method uses a specifically designed screen and quite large gravel placed with a prior treatment of consolidating plastic. A resin material is first introduced into the formation before the well is gravel-packed with large gravel. The resin consolidates the formation sand that remains in direct contact with the pack gravel after the job is completed. The use of large gravel maximizes productivity throughout the gravel-packed interval and especially in the perforation tunnels. The pack gravel need not be sized to bridge the formation sand since the formation sand has been consolidated in the region where invasion would occur. A screen is used with the gravel pack that is sized to stop the entry of formation sand rather than sized to hold back the pack gravel. This makes the system fail-safe from the standpoint of formation-sand production.

In U.S. Pat. No. 3,826,310 there is described a well treatment technique for sand control. The well is treated by injecting a slurry of packing grains, self-curing resin, and carrier liquid to form a permeable resin-consolidated mass of grains in or around a cased and perforated section of well casing ahead of a fluid-transported mass of solid particles that have a size and composition adapted to form chemically removable plugs across the openings of casing perforations that have been filled with the slurry. Substantially all of the slurry is displaced from the casing interior into the perforations in the perforated section of the casing. After allowing the resin-consolidated packs to cure, the chemically removable plugs are removed, e.g. by circulating a plug-dissolving fluid into the well until at least enough of the plugging particles are dissolved to provide passageways into the perforations.

SUMMARY OF THE INVENTION

This invention is directed to a method of completing a well that penetrates a subterranean formation, which well has casing therein and perforation tunnels that extend through the casing and communicate with the formation. Removable plugs are formed in the perforation tunnels. Thereafter, an inside-the-casing consolidated gravel pack is formed adjacent the perforation tunnels. The removable plugs are then removed from the perforation tunnels to provide unobstructed perforation tunnels.

DESCRIPTION OF THE PREFERRED EMBODIMENTS

This invention is concerned with a method of completing a cased and perforated well to control the production of formation particles, hereinafter referred to as sand, from a fluid-bearing subterranean formation. More particularly, this invention is concerned with a sand-control technique wherein an inside-the-casing gravel pack is formed in the well adjacent perforation tunnels which extend from the well and communicate with the formation and, in particular, is concerned with maintaining the perforation tunnels unobstructed and free of pack gravel. Obstructions in the perforation tunnels can appreciably reduce the flow conductivity of the perforation tunnels. Heretofore in forming inside-the-casing gravel packs it has been common practice to allow the pack gravel placed in the well to flow into the perforation tunnels. However, this pack gravel partially obstructs the perforation tunnels and reduces the flow conductivity thereof. By this invention, the perforation tunnels are maintained free of obstruction by the pack gravel.

Figure 1:
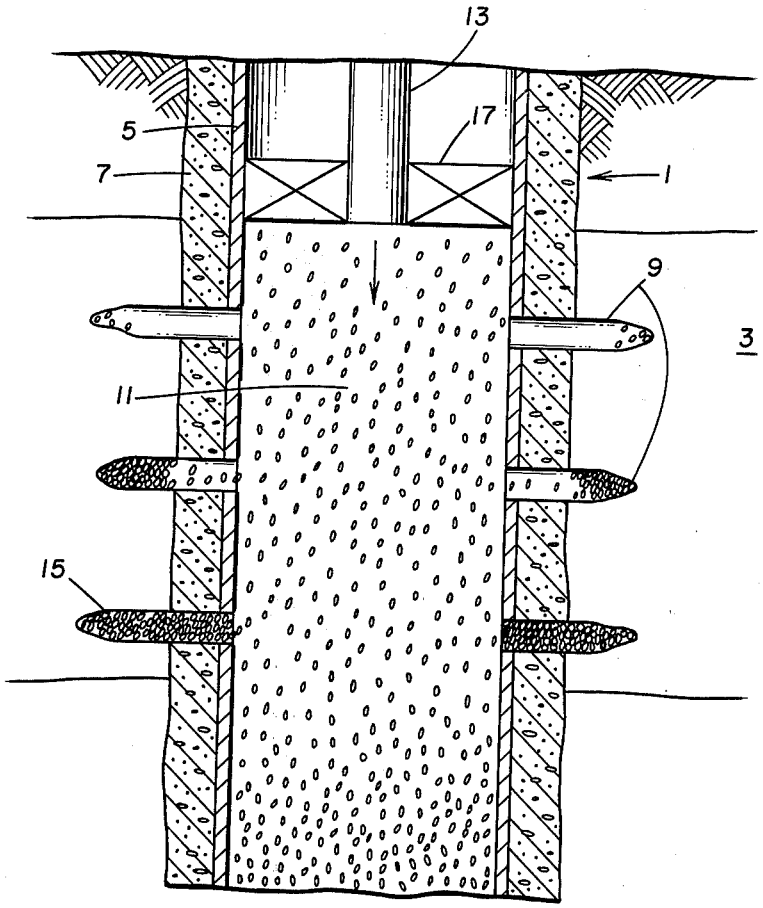
FIGS. 1, 2, and 3 are schematic views of a well extending through a subterranean formation and illustrate the invention.

Referring now to FIG. 1, there is shown a well 1 which penetrates a subterranean formation 3 such as an unconsolidated hydrocarbon-bearing formation. Casing 5 is provided in the well 1 and surrounded by a cement sheath 7. Perforation tunnels 9 are provided to extend through the casing 5, cement sheath 7, and communicate with the subterranean formation 3. Granular material 11 for forming plugs that may be removed chemically or thermally is injected down the well 1 via a tubing string 13 and into the perforation tunnels 9 to form removable plugs 15 in the perforation tunnels 9. The granular material 11 is normally injected down the tubing 13 as a liquid slurry. A packer 17 may be set in the well to isolate that portion of the well penetrating the formation 3 from the portion of the well thereabove. The liquid slurry is forced into the perforation tunnels 9 where the granular material is filtered out against the formation and forms the removable plugs 15 in the tunnels 9. The granular material 11 is selected to be chemically or thermally removable from the perforation tunnels 9 and to have a size sufficiently small to allow the granular particles to flow into the perforation tunnels 9 and sufficiently large to ensure that the granular material will be filtered out against the formation 3. The granular material thus enters the perforation tunnels 9 and forms the removable plugs 15 therein as illustrated in the lower perforation tunnels 9. The middle perforation tunnels illustrate removable plugs partially formed therein. Desirably sufficient granular material 11 is injected down the well to form removable plugs in all of the perforation tunnels 9.

Suitable granular material 11 for forming the removable plugs 15 is calcium carbonate pellets. A plug so formed may be removed by injecting an acid such as hydrochloric acid down the well 1 and into contact with the removable plugs 15. Other suitable granular material may be readily selected from materials available in the oil industry and known as diverting agents and blocking agents. For example, diverting agents sold under the registered trademark of "Unibeads" may be selected for use on the basis of oil solubility and melting temperature characteristics. Plugs formed of Unibeads may be removed chemically by dissolving or thermally by melting. This may readily be done by injecting a selected fluid into the well to dissolve or melt the plugs as appropriate. Other suitable materials for use in forming the removable plugs are plug-forming solid particles as described in U.S. Pat. No. 3,826,310. It is there indicated that suitable solid particles for forming chemically removable plugs include particles of benzoic acid, for example those commercially available as "Divert 2" supplied by Byron Jackson, Inc.; naphthalene; relatively readily hydrolyzable or oil-soluble resins, and/or waxes; and mixtures of such particles with each other.

Figure 2:
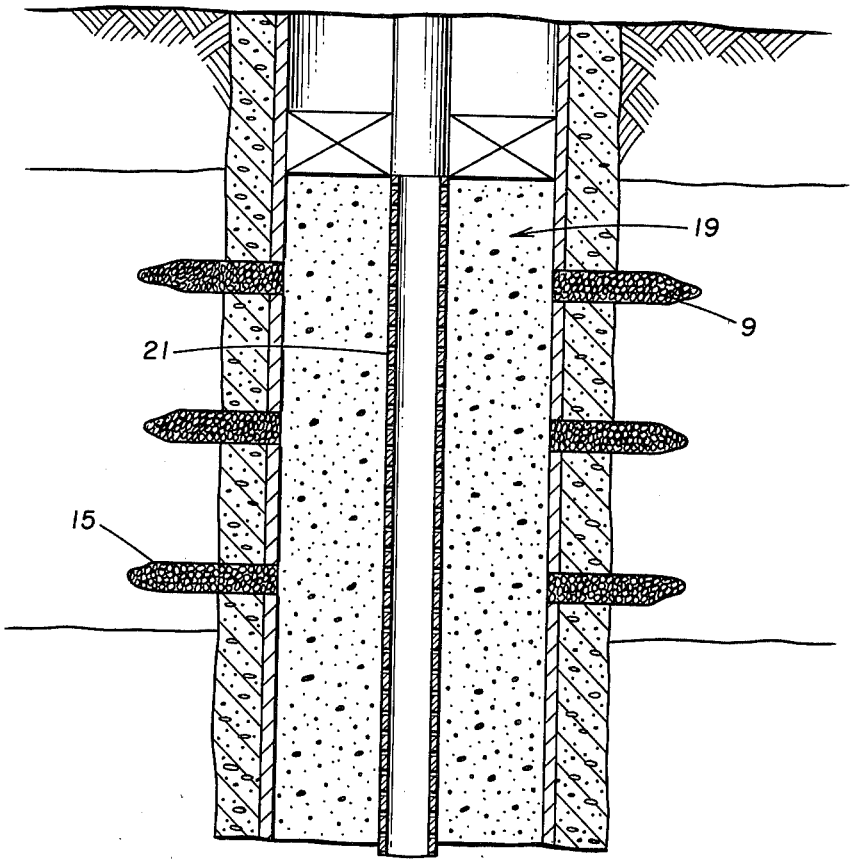

After plugging the perforation tunnels 9 with the removable plugs 15, an inside-the-casing gravel pack is formed adjacent the perforation tunnels 9, as illustrated by the gravel pack 19 of FIG. 2. The gravel pack 19 is illustrated as being formed about a slotted screen 21. The gravel pack 19 used in accordance with this invention is an inside-the-casing gravel pack and is consolidated such that gravel from the pack will not flow into and partially block the perforation tunnels 9 when the removable plug 15 is removed therefrom. Methods of forming consolidated gravel packs are well known. In U.S. Pat. No. 3,696,867, there is described a method of forming a consolidated gravel pack. Another method of forming a consolidated gravel pack is described in U.S. Pat. No. 3,443,637. Other methods are described in the aforementioned article by George O. Suman, Jr.

Figure 3:
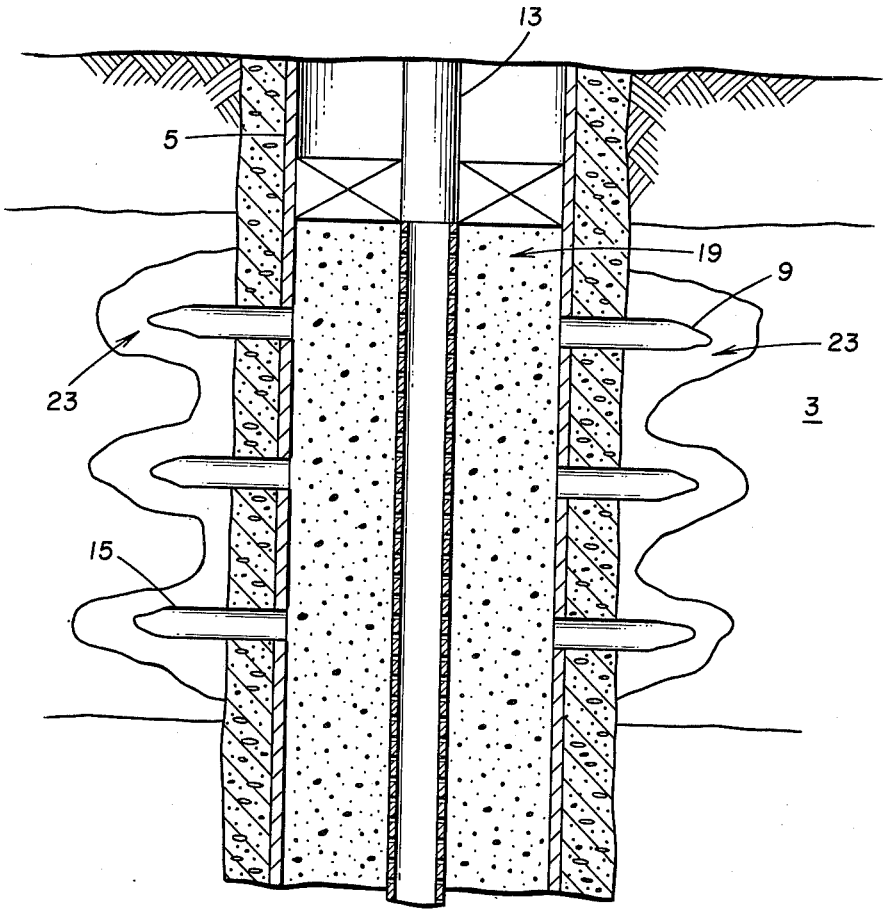

After forming the inside-the-casing consolidated gravel pack 19 adjacent the perforation tunnels 9, the removable plugs 15 are removed from the perforation tunnels 9 to provide unobstructed communication via the perforation tunnels intermediate the interior of the casing 5 and the subterranean formation 3 as illustrated in FIG. 3. The technique used for removing the removable plugs 15 from the perforation tunnels 9 will depend upon the type of material used for forming the removable plugs 15. For example, if the plugs are chemically removable, a solvent may be injected down the tubing 13 and through the inside-the-casing gravel pack 19 to contact the removable plugs 15 and solubilize them. If the removable plugs 15 are soluble in oil and the subterranean formation 3 is an oil-bearing formation, the well may be put on production and the plugs removed by the oil as it flows through the perforation tunnels into the well.

In accordance with another embodiment of this invention, a sand consolidation chemical is injected down the well and through the perforation tunnels 9 to consolidate the formation adjacent the perforation tunnels as illustrated by the zone 23 in FIG. 3. The consolidation chemicals may be injected into the formation 3 at any selected time during the completion process. For example, the consolidation chemicals may be injected down the tubing 13 and into the formation 3 prior to the placement of the granular material 11 in the perforation tunnels 9 or simultaneously therewith. In accordance with another embodiment, the granular material 11 may be added to a tail portion of the sand consolidation material to thereby deposit the granular material 11 in the perforation tunnels 9 and form the removable plugs therein. In accordance with still another aspect of this invention, the granular material 11 may be deposited in the perforation tunnels 9 and thereafter an inside-the-casing gravel pack formed adjacent the perforation tunnels 9. A consolidation chemical may then be injected down the tubing 13 through the inside-the-casing gravel pack and the removable plugs 15, which are permeable due to their being formed of granular material, and into the formation adjacent the perforation tunnels to consolidate the gravel pack, removable plugs and the formation.

I claim:

1. A method of completing a well that penetrates a subterranean formation, said well having casing therein and perforation tunnels that extend through said casing and communicate with said formation, comprising:

a. forming removable plugs in said perforation tunnels;

b. thereafter forming an inside-the-casing consolidated gravel pack adjacent said perforation tunnels; and c. thereafter chemically or thermally removing said removable plugs to provide unobstructed perforation tunnels communicating with said inside — the — casing consolidated gravel pack.

2. the method of claim 1 further comprising consolidating said formation adjacent said perforation tunnels.

3. A method of completing a well that penetrates a subterranean formation, said well having casing therein and having perforation tunnels that extend through said casing and communicate with said formation, comprising:

a. injecting removable granular materials down said well and into said perforation tunnels to form removable plugs therein;

b. forming an inside-the-casing consolidated gravel pack adjacent said perforation tunnels; and c. injecting a fluid down said well to chemically or thermally remove said plugs thereby providing unobstructed perforation tunnels communicating with said inside — the — casing consolidated gravel pack.

4. The method of claim 3 wherein said removable granular materials are of a size sufficiently small to pass through said perforation tunnels and sufficiently large to bridge the pores of said formation and wherein said granular materials are injected down said well in sufficient quantity to fill said perforation tunnels.

5. The method of claim 4 wherein said granular materials are chemically removable and wherein said fluid that is injected down said well is a solvent.

6. The method of claim 5 wherein said chemically removable granular materials are comprised of calcium carbonate and wherein said chemical is comprised of an acid.

7. The method of claim 4 wherein said granular materials are thermally removable and wherein said fluid that is injected down said well and into contact with said removable plugs is sufficiently hot to melt and remove said plugs.

8. A method of completing a well that penetrates a subterranean unconsolidated formation to control the production of sand therefrom, said well having casing therein and perforation tunnels that extend through said casing and communicte with said formation, comprising:

a. injecting a sand consolidation chemical via said well and said perforation tunnels into said formation to consolidate said formation adjacent said perforation tunnels;

b. adding to a tail portion of said sand consolidation chemical granular material for forming removable plugs whereby said material is deposited in said perforation tunnels and removable plugs are formed therein;

c. forming a consolidated gravel pack inside said casing adjacent said perforation tunnels; and d. injecting a fluid down said well to chemically or thermally remove said removable plugs from said perforation tunnels thereby providing unobstructed perforation tunnels communicating with said consolidated gravel pack.

* * * * *